US008578875B1

(12) United States Patent
Lee

(10) Patent No.: US 8,578,875 B1
(45) Date of Patent: Nov. 12, 2013

(54) PORTABLE SCORE INDICATOR

(76) Inventor: Alexander Lee, Wichita, KS (US)

( * ) Notice: Subject to any disclaimer, the term of this patent is extended or adjusted under 35 U.S.C. 154(b) by 340 days.

(21) Appl. No.: 13/193,600

(22) Filed: Jul. 28, 2011

(51) Int. Cl.
*A63B 71/06* (2006.01)

(52) U.S. Cl.
USPC ..... 116/222; 273/DIG. 26

(58) Field of Classification Search
USPC ..... 116/222, 223, 224, 225, 303, 306, 309, 116/321, 325, 200; 40/492, 530, 533; 235/1 B; 273/DIG. 26; D10/46.1
See application file for complete search history.

(56) References Cited

U.S. PATENT DOCUMENTS

| | | | | | |
|---|---|---|---|---|---|
| 391,185 | A | * | 10/1888 | Parker | 116/319 |
| 485,967 | A | * | 11/1892 | Mosher et al. | 40/492 |
| 937,264 | A | * | 10/1909 | Philbrick | 40/492 |
| 1,708,567 | A | * | 4/1929 | Corcoran | 40/310 |
| 2,025,151 | A | * | 12/1935 | Brillinger | 116/319 |
| 3,922,805 | A | * | 12/1975 | Krug | 40/533 |
| 4,070,775 | A | * | 1/1978 | Brooks | 40/492 |
| 4,104,809 | A | * | 8/1978 | Day et al. | 434/104 |
| D300,435 | S | * | 3/1989 | Harris et al. | D20/19 |
| 4,831,956 | A | * | 5/1989 | Thater | 116/222 |
| 5,025,748 | A | * | 6/1991 | Pettis | 116/222 |
| 5,385,113 | A | * | 1/1995 | Hierath | 116/222 |
| 5,733,210 | A | * | 3/1998 | Yiu | 473/475 |
| D418,431 | S | * | 1/2000 | Niksich | D10/46.1 |
| 6,041,934 | A | * | 3/2000 | Alexson | 206/579 |
| 6,234,918 | B1 | * | 5/2001 | Nally et al. | 473/473 |
| 6,578,513 | B1 | * | 6/2003 | Niksich | 116/222 |
| 6,665,965 | B1 | * | 12/2003 | Turchi et al. | 40/492 |
| 6,814,022 | B1 | * | 11/2004 | West | 116/28 R |
| D688,310 | S | * | 8/2013 | Mauris | D20/18 |

FOREIGN PATENT DOCUMENTS

| | | | | |
|---|---|---|---|---|
| DE | 202006009516 | * | 9/2006 | A63B 71/06 |

* cited by examiner

*Primary Examiner* — R. A. Smith
(74) *Attorney, Agent, or Firm* — QuickPatents; Kevin Prince

(57) ABSTRACT

A scorekeeping device is disclosed for use with a sports court that has a net in order to keep score in a match between players. The scorekeeping device comprises three elongated members, each mutually connected at top ends thereof with a pivot to define a center member and two outer members. A score indicia is fixed to both sides of the center member. The score indicia may indicate the numbers 1 through 7, representing games in a set of tennis, for example. A pair of contrasting score indicators, such as differently-colored spring-biased clips, are selectively fixable with the center member. Preferably, in an extended position the height of the device is three feet, such that the device may be used to adjust or otherwise measure the height of a tennis net, for example.

11 Claims, 3 Drawing Sheets

PORTABLE SCORE INDICATOR

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to games and sports, and more particularly to a score keeping indicator for games such as tennis.

DISCUSSION OF RELATED ART

Tennis is a game played on a tennis court between two or four players. A tennis court is rectangular in shape with a net dividing it into two sides. Players compete against each when a player or team is unable to return the ball to the opposing side. A game is won when a player or team receives at least 4 points and two more than the opponent.

The first, second, and third points are termed 'fifteen,' 'thirty,' and 'forty,' while having zero points is termed 'love.' If both sides have 3 points, the score is 'deuce' and the subsequent point is an 'advantage.' If a player with an 'advantage' scores a point, he wins the game, and if he loses the point, the score returns to 'deuce.' The score is typically communicated after each point for clarity. A set comprises a series of games with service alternating between sides, the winner typically besting their opponent by winning at least 6 games and two more than their opponent. The winner of a tennis match is the winner of 3 or 5 sets.

Tennis games suffer from a confusing scoring system, with several games, sets, and matches that must be remembered, each with their own scoring requirements. While the score is communicated after each point, it is often easy to forget the score of the game, set, or match, and sometimes all three. While tennis scoring devices have been developed, most suffer from drawbacks such as being cumbersome, intrusive, insecure, and difficult to use effectively.

U.S. Pat. No. 6,578,513 to Niksich on Jun. 17, 2003, describes a tennis scoring device comprising a plastic pipe and seven pairs of holes for inserting tennis balls. This device is intended to be attached to a tennis net post and keep the score of the contest using tennis balls. This invention is cumbersome and intrusive to a tennis game, as it is rather large and may interfere with the path of the ball during a tennis game.

U.S. Pat. No. 5,385,113 to Hierath on Jan. 31, 1995, describes a tennis scoring device comprising a row of 9 vertically placed pockets and numbers on a support pole. This device is intended to be attached to a tennis net post with an attachment bracket and to keep the score of the contest by placing and removing balls from the pockets. Again, this invention is cumbersome and intrusive to a tennis game, being large and possibly interfering with the path of the ball during a tennis game.

U.S. Pat. No. 5,025,748 to Pettis on Jun. 25, 1991, describes a portable scoring device which includes a retractable and extendable post section with is driven into the ground and supports a score display panel. This device has 25 vertically placed numbers on either side of the score display panel and several clips for keeping the score of the game. This invention is cumbersome due to its length and confusing due to the 25 numbers which may not correlate with the game of tennis very well.

U.S. Pat. No. 4,831,956 to Thater on Jun. May 23, 1989, describes a full size tennis scoring apparatus which includes a foldable fabric scoring panel with room for players' names and set, game, and point scoring tallies. This device is intended to be affixed to the netting or netting post to allow the players to keep score with paddle-shaped markers invention may obstruct the players' view of the opposing sides, and may be struck with balls, causing the paddle-shaped markers to be jettisoned from their scoring positions.

Therefore, there is a need for a device that allows for quick, clear, and easy scorekeeping of a tennis game without having a cumbersome and intrusive impact on the game. Such a device would be portable and compact, encouraging its use by folding into itself for placement inside gym bags. Further, such a device would secure itself to the net and post, retaining an accurate score of the game even if it is struck by a wayward ball. The present invention accomplishes these objectives.

SUMMARY OF THE INVENTION

The present device is a scorekeeping device for use with a sports court that has a net in order to keep score in a match between players. The scorekeeping device comprises three elongated members, each mutually connected at top ends thereof with a pivot to define a center member and two outer members. A score indicia is fixed to both sides of the center member. The score indicia may indicate the numbers 1 through 7, representing games in a set of tennis, for example. A pair of contrasting score indicators, such as differently-colored spring-biased clips, are selectively fixable with the center member.

In use, with the center member pivoted to an extended position opposite the two outer members, and with the two outer members weaved through, or otherwise attached to the net or associated hardware, the score indicia of the center member are visible to the players above the net and the score indicators can be set to indicate the players' scores in the match. Upon conclusion of the match the center member may be pivoted around to a compact position aligned with the outer members for compact storage. Preferably in the extended position the height of the device is substantially three feet, such that the device may be used to adjust or otherwise measure the height of the net.

The present invention is a device that allows for quick, clear, and easy scorekeeping of a tennis game without having a cumbersome and intrusive impact on the game. The present invention is portable and has a compact profile to encourage its use. Further, the present invention secures itself to the net and post, retaining an accurate score of the game even if it is struck by a wayward ball. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
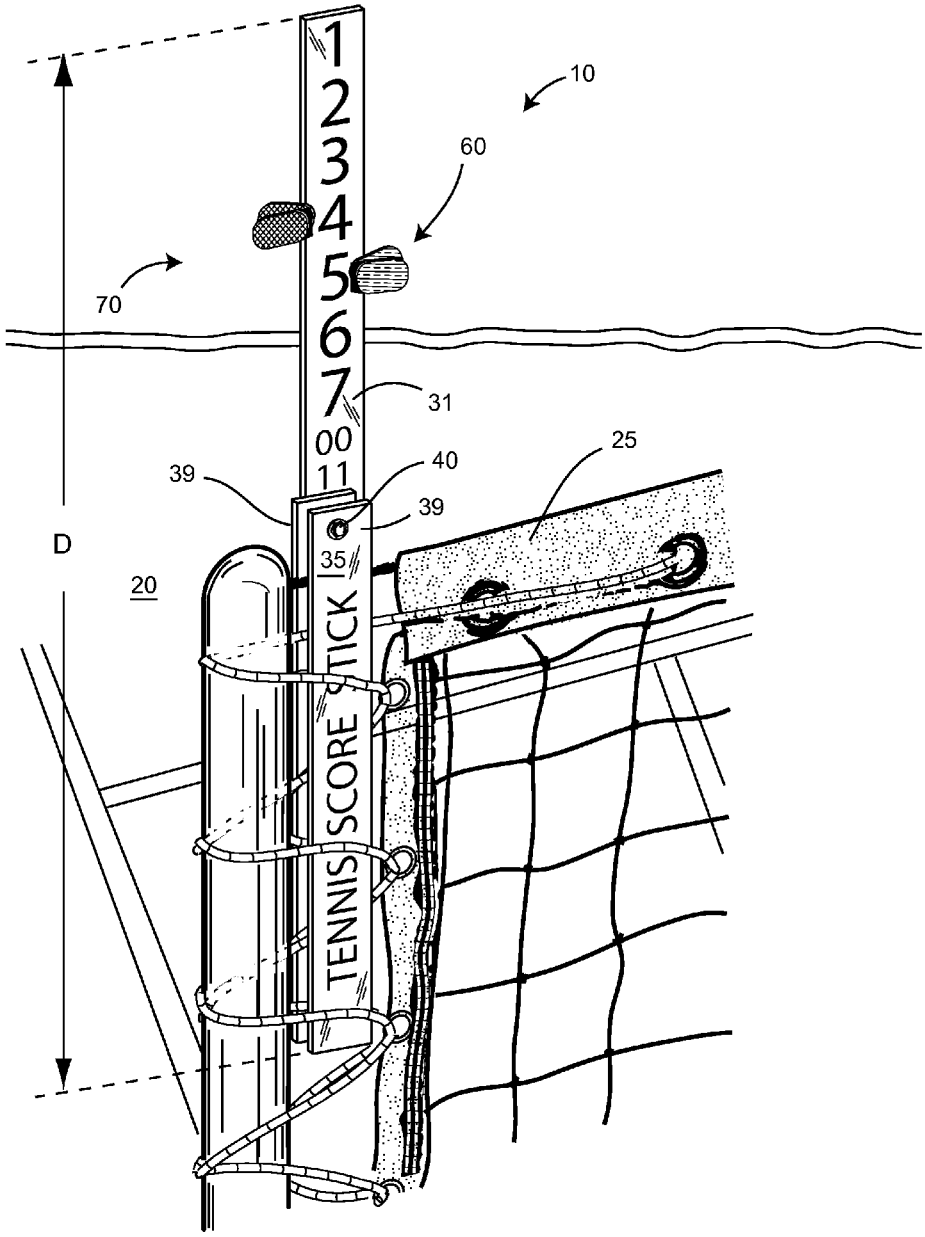
FIG. 1 is a perspective view of the invention, illustrated in an extended position.
Figure 2:
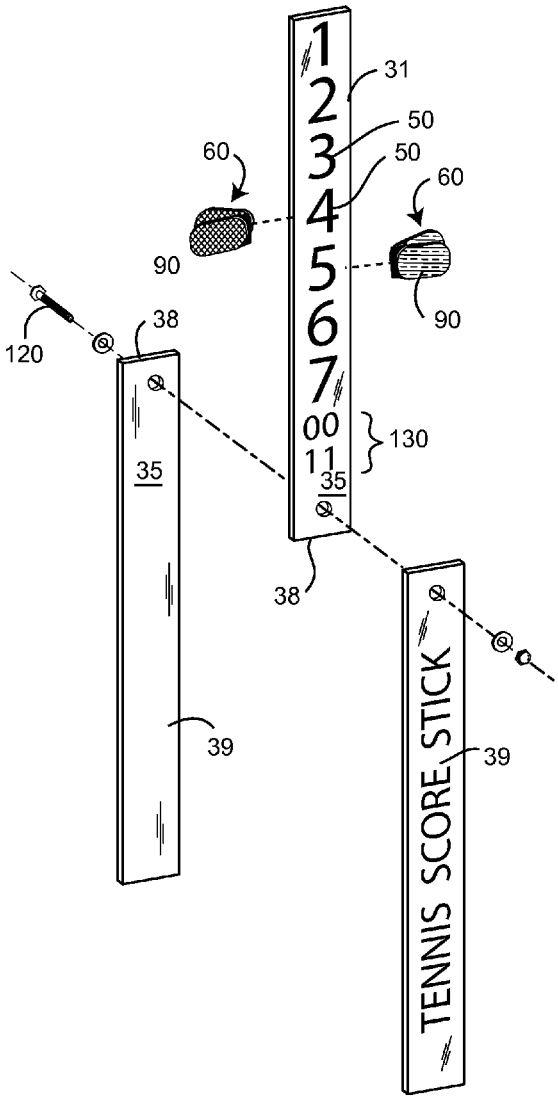
FIG. 2 is an exploded perspective view thereof.
Figure 3:
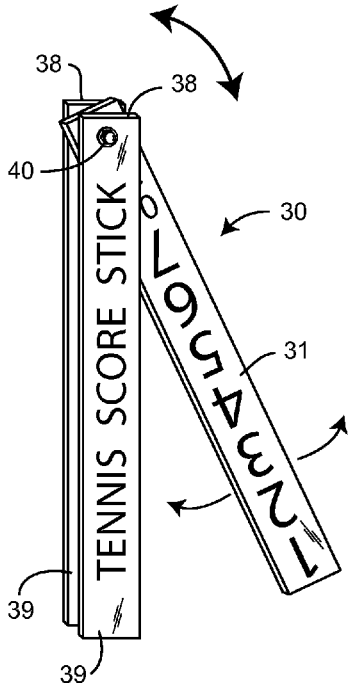
FIG. 3 is a perspective view of the invention, illustrated in a partially extended position.

FIGS. 1 and 2 illustrate a scorekeeping device 10 for use with a tennis court 20 that has a net 25 in order to keep score in a match between players. The scorekeeping device 10 comprises three elongated members 30, each mutually connected at top ends 38 thereof with a pivot 40 to define a center member 31 and two outer members 39. Preferably each member 30 is made from a rigid or resilient water-impermeable material, such as nylon, ABS, PVC, or other plastic materials, and all three elongated members 30 are preferably formed with a substantially identical cross-sectional shape and size. The pivot 40 may be a mechanical threaded fastener 120 (FIG. 2), a rivet (not shown), or the like.

A score indicia 50 is fixed to both sides 35 of the center member 31. Such a score indicia 50 may be applied to the center member 31 with pad printing, silk-screening, or the like, or may be applied as vinyl overlays or the like. Alternately, the center member 31 may include the indicia 50 formed therein through a plastic molding process, for example. The score indicia 50 may indicate the numbers 1 through 7, representing games in a set of tennis, for example. Further, the score indicia 50 may include a set indicator 130 for designating how many sets each player has won.

Figure 5:
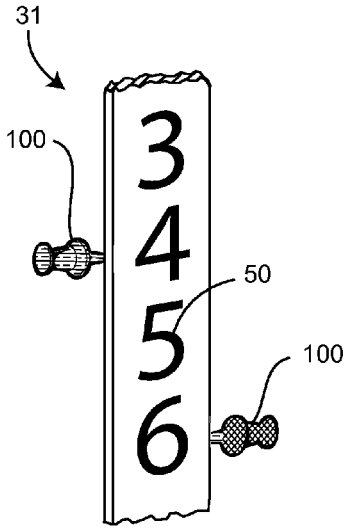
FIG. 5 is a partial perspective view of the invention, illustrating one embodiment of a pair of score indicators.
Figure 6:
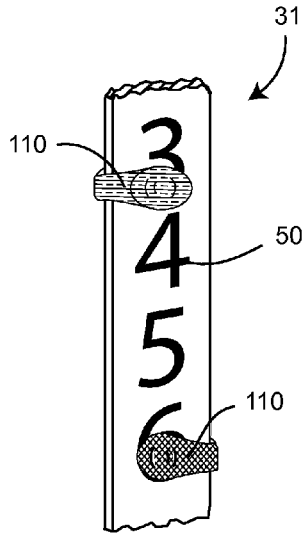
FIG. 6 is a partial perspective view of the invention, illustrating another embodiment of a pair of score indicators.

A pair of contrasting score indicators 60 are selectively fixable with the center member 31. Preferably, as illustrated in FIGS. 1 and 2, the score indicators 60 are each differently-colored spring-biased clips 90. Alternately, the score indicators 60 may be contrasting push pins 100 (FIG. 5). In one embodiment, the score indicators 60 may be magnetic clips 110 (FIG. 6) wherein the elongated members 30 are each magnetically inert so that magnets (not shown) within the clips 110 may attract each other through the elongated members 30, or alternately, the elongated members 30 may each be made from a magnetically attractive metal or metal coated material, such that a single magnet (not shown) in the clips 110 will be attracted thereto.

Figure 4:
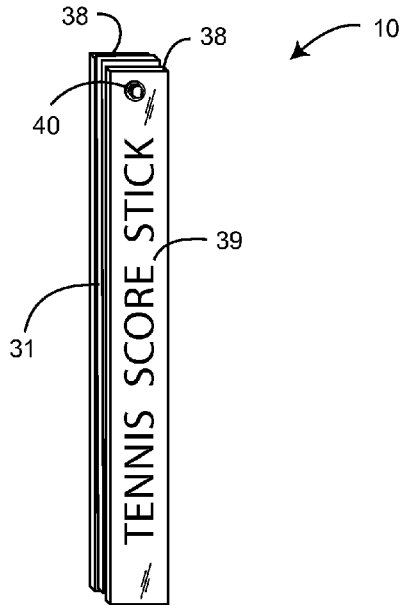
FIG. 4 is a perspective view of the invention, illustrated in a closed position.

In use, with the center member 31 pivoted to an extended position 70 (FIG. 1) opposite the two outer members 39, and with the two outer members 39 weaved through the net 25, the score indicia 50 of the center member 31 are visible to the players above the net 25 and the score indicators 60 can be set to indicate the players' scores in the match. Upon conclusion of the match the center member 31 may be pivoted around to a compact position 80 (FIG. 4) aligned with the outer members 39 for compact storage.

Preferably in the extended position 70 the height D of the device 10 is substantially three feet, such that the device 10 may be used to adjust or otherwise measure the height of the net 25. While the game of tennis requires a net height of three feet, clearly other heights D can be established for use with other games.

While a particular form of the invention has been illustrated and described, it will be apparent that various modifications can be made without departing from the spirit and scope of the invention. For example, such a scorekeeping device 10 may be used with a volleyball court 20 and volleyball net 25 in a similar fashion, but with appropriate score indicia 50. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A scorekeeping device for use with a sports court having a net to keep score in a match between players, comprising:

three elongated members, mutually connected at top ends thereof with a pivot to define a center member and two outer members;

score indicia fixed to both sides of the center member; and a pair of contrasting score indicators selectively fixable with the center member;

whereby with the center member pivoted to an extended position opposite the two outer members, and wherein the two outer members are configured to be weaved through the net, the score indicia of the center member is visible to the players and the score indicators can be set to indicate the players' scores in the match; and whereby upon conclusion of the match the center member may be pivoted around to a compact position aligned with the outer members for compact storage.

2. The scorekeeping device of claim 1 wherein the height of the device in the extended position is substantially three feet.

3. The scorekeeping device of claim 1 wherein each elongated member is made from a water-proof material.

4. The scorekeeping device of claim 3 wherein the water-proof material is a plastic material.

5. The scorekeeping device of claim 1 wherein the score indicators are each spring-biased clips.

6. The scorekeeping device of claim 1 wherein the score indicators are each push pins.

7. The scorekeeping device of claim 1 wherein the score indicators are each magnetic clips.

8. The scorekeeping device of claim 1 wherein the pivot is a mechanical threaded fastener.

9. The scorekeeping device of claim 1 wherein the score indicia are the numbers 1 through 7, representing games in a set of tennis.

10. The scorekeeping device of claim 9 wherein the score indicia include a set indicator for designating how many sets each player has won.

11. The scorekeeping device of claim 1 wherein each elongated member is substantially identical in cross-sectional shape and length.

* * * * *